US006910977B2

(12) United States Patent
Baquero

(10) Patent No.: US 6,910,977 B2
(45) Date of Patent: Jun. 28, 2005

(54) WAIST AND KNEE POWERED PROJECTILE PROPELLING DEVICE

(76) Inventor: Pedro Baquero, 15 La Rose Avenue Apr 1508, Toronto (CA), M9P1A7

( * ) Notice: Subject to any disclaimer, the term of this patent is extended or adjusted under 35 U.S.C. 154(b) by 3 days.

(21) Appl. No.: 10/708,139

(22) Filed: Feb. 8, 2004

(65) Prior Publication Data

US 2004/0185972 A1 Sep. 23, 2004

Related U.S. Application Data

(60) Provisional application No. 60/454,649, filed on Mar. 17, 2003.

(51) Int. Cl.[7] ..... A63B 59/00
(52) U.S. Cl. ..... 473/518; 273/DIG. 19
(58) Field of Search ..... 273/317, 340, 273/440, 444, 459, DIG. 19, 118 R, 119 R, 129 R, 129 V, 129 W; 473/518, 558, 559

(56) References Cited

U.S. PATENT DOCUMENTS 735,132 A * 8/1903 McCutchen, Jr. ..... 273/119 R
1,098,680 A * 6/1914 Palmer ..... 273/119 R
2,317,289 A * 4/1943 McDonald ..... 273/129 R
2,793,037 A * 5/1957 Smith ..... 273/108.2
2,910,296 A * 10/1959 Irwin ..... 273/108.31
3,015,908 A * 1/1962 Colletti ..... 446/265
3,200,536 A * 8/1965 Petitto, Sr. ..... 446/28
3,508,359 A * 4/1970 Glass et al. ..... 446/265
3,931,973 A * 1/1976 Moe ..... 273/123 R
D239,648 S * 4/1976 Somsky ..... D21/466

* cited by examiner

*Primary Examiner*—Raleigh W. Chiu
(74) *Attorney, Agent, or Firm*—Jeffrey Furr

(57) ABSTRACT

The present invention relates to a device and game that consists of an elongated body or rod with a pendulum-like club hanging from one of its sides. The device has a strap that fastens the device to the user's body and a handle that at the opposite end of the club end which aids in the replacing of clubs and also provides extra support while in operation. The plane of rotation is perpendicular to the body of the device. The head of the club is fitted with a flat area that faces in the direction of motion and is used to strike the projectile forward towards a target when the device is in use.

11 Claims, 10 Drawing Sheets

WAIST AND KNEE POWERED PROJECTILE PROPELLING DEVICE

CROSS REFERENCE TO RELATED APPLICATIONS

This application refers back to Provisional Application No. 60/454,649 with a filing date of Mar. 17, 2003.

BACKGROUND OF INVENTION

This invention relates to a method and a device for propelling projectiles that can be used for amusement and competition in a game of target shooting. The device is adapted to be activated through movement of user's body, namely waist and knees.

BACKGROUND

Humans have been entertaining themselves through games and sports for thousands of years. Humans have always had a competitive spirit from the first hunting competition to modern professional sports.

There are many types of skill games such as darts, lawn dart, croquet, disk golf and bowling. All take skill and strategy. People are always looking for the next type of game to compete in.

There is still room for improvement in the art.

SUMMARY OF INVENTION

The present invention relates to a device and game that consists of an elongated body or rod with a pendulum-like club hanging from one of its sides. The device has an adjustable strap that fastens the device to the user's body. It may have a handle at the opposite end of the club to aid in the replacing of clubs into the pivot and also for extra support while in operation, if needed.

The club is attached to the body of the devise by a pivoting means that locates the center of rotation and allows the club's head to spin in an orbit around the pivot axis. The plan of rotation is perpendicular to the rod of the device. The head of the club is fitted with a flat area that faces in the direction of motion and is used to strike the projectile forward when the device is in use.

The clubs are adapted to be replaced from the pivot with ease. This feature allows for quick replacements for clubs with different lengths and shapes needed to shoot accurately as target locations and degrees of difficulty change, and allows disassembly of the device for easy storage and handling when not in use.

BRIEF DESCRIPTION OF DRAWINGS

Without restricting the full scope of this invention, the preferred form of this invention is illustrated in the following drawings.

DETAILED DESCRIPTION

The following description is demonstrative in nature and is not intended to limit the scope of the invention or its application of uses.

There are a number of significant design features and improvements incorporated within the invention.

Figure 1:
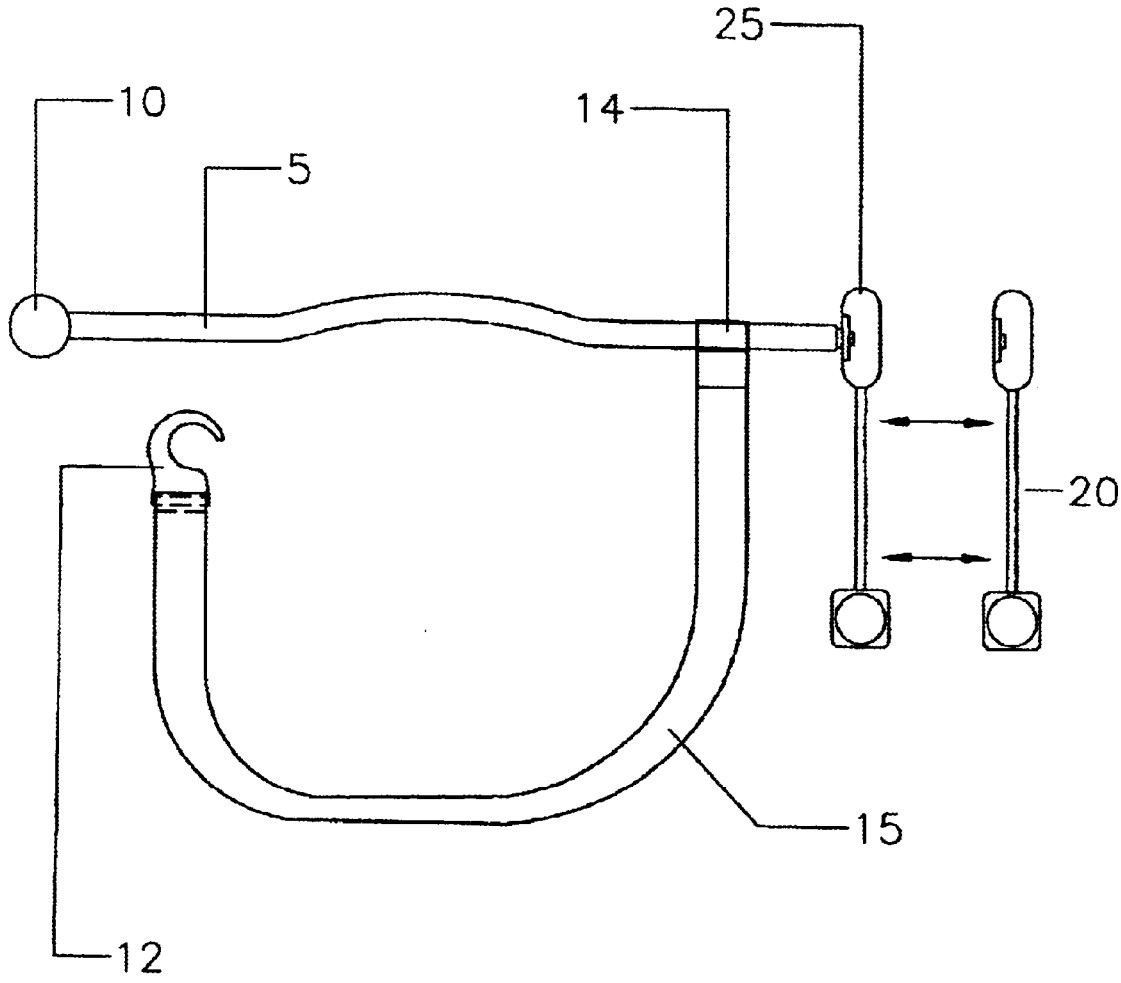
FIG. 1 shows the basic components of the invention.

As shown in FIG. 1, the current invention is a device and a game. The device 1 is used to hit a projectile 120 towards a target 100.

The main components of the device 1 consist of an elongated body or rod 5 with a pendulum-like club 20 hanging from one of its sides. It also has an elastic strap 15 and a hook mechanism 12 that fastens the device 1 to the user's body 40. It has a handle 10 that at the opposite end of which the club 20 is positioned to aid in the replacing of clubs 20 onto the rod 5 and for extra support while in operation, if needed.

In the preferred embodiment, the rod 5 is about 2 feet long and ¾ in. in diameter and made of a light strong material such as aluminum. The rod 5 is contoured to fit a player's 45 body 40, making it more ergonomic and easier to use.

The rod has a handle 10 on one end of it. The handle 10 is used in aid of replacing clubs 20 into the rod 5 and also for extra support while in operation, if needed. The handle 10 is a balled material made of a rubber or plastic that is soft yet provides a good grip. The handle is attached to the end of the rod 5 that is opposite the club 20.

Figure 3:
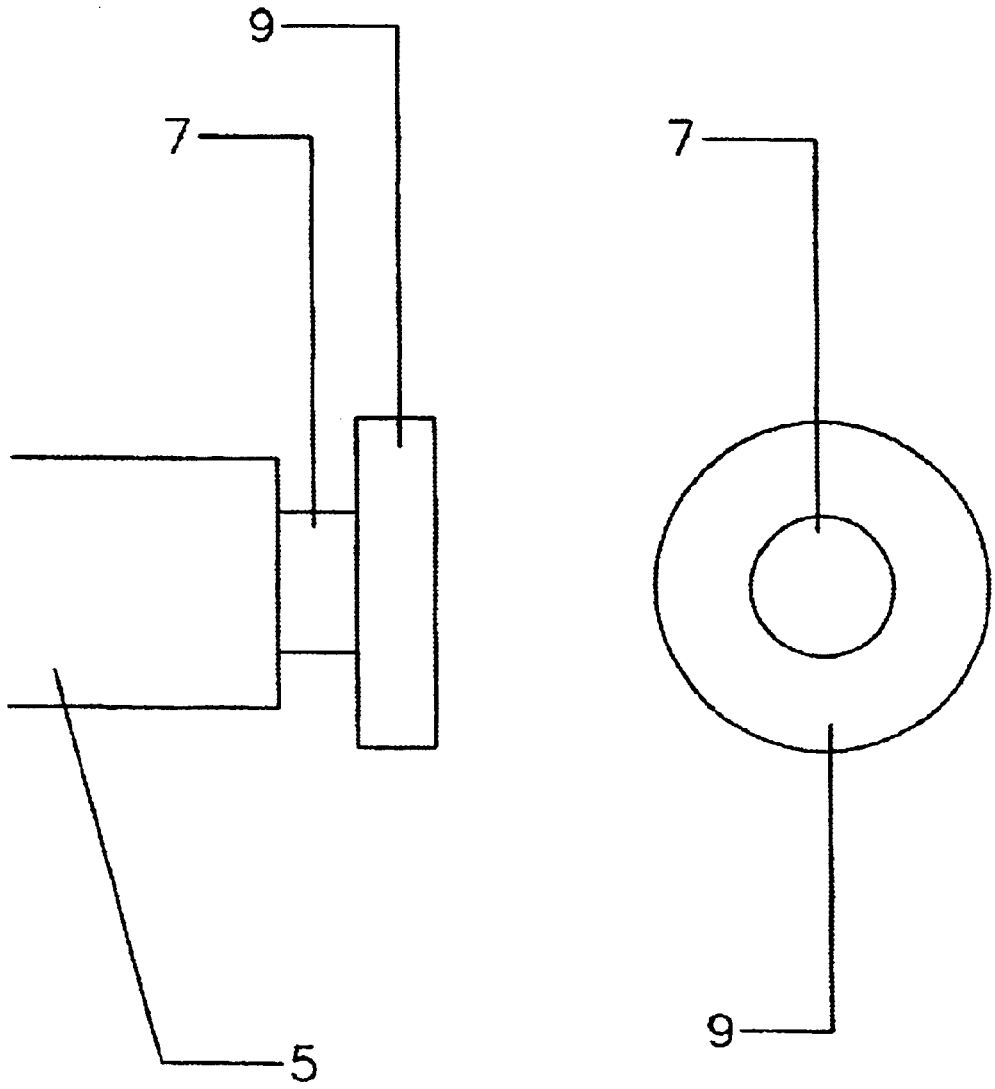
FIG. 3 displays the caster of the pivoting means.

On the opposite end of the handle 10, the rod 5 has a pivoting means 25. In the preferred embodiment, as shown in FIG. 3, the rod 5 diameter is reduced to approximately ⅜ inch for the last ⅝ inch to form an axle 7. On this axle 7 a caster 9 is attached through an attaching means such as welding. This caster 9/axle 7 combination forms the pivoting means 25. The caster 9 used can be a standard ball bearing type caster.

The rod 5 has an elastic strap 15. One end of the elastic strap 15 is connected to the rod 5. In the preferred embodiment, the strap 15 is looped 14 around the rod 5 with the end of the strap 15 attached to the strap 15 through an attachment means such as sewing, clips or heat press. The strap 15 is free to move up and down the rod for a better fit on the player's 45 body 40.

A hook 12 is attached to the strap at the end of the strap 15 that is not attached to the rod 5. This hook 15 is used by the player 45 to connect the device 1 to their body 40. The strap 15 goes around the player's 45 body 40 and the hook 12 is hooked around the rod 5.

Figure 4:
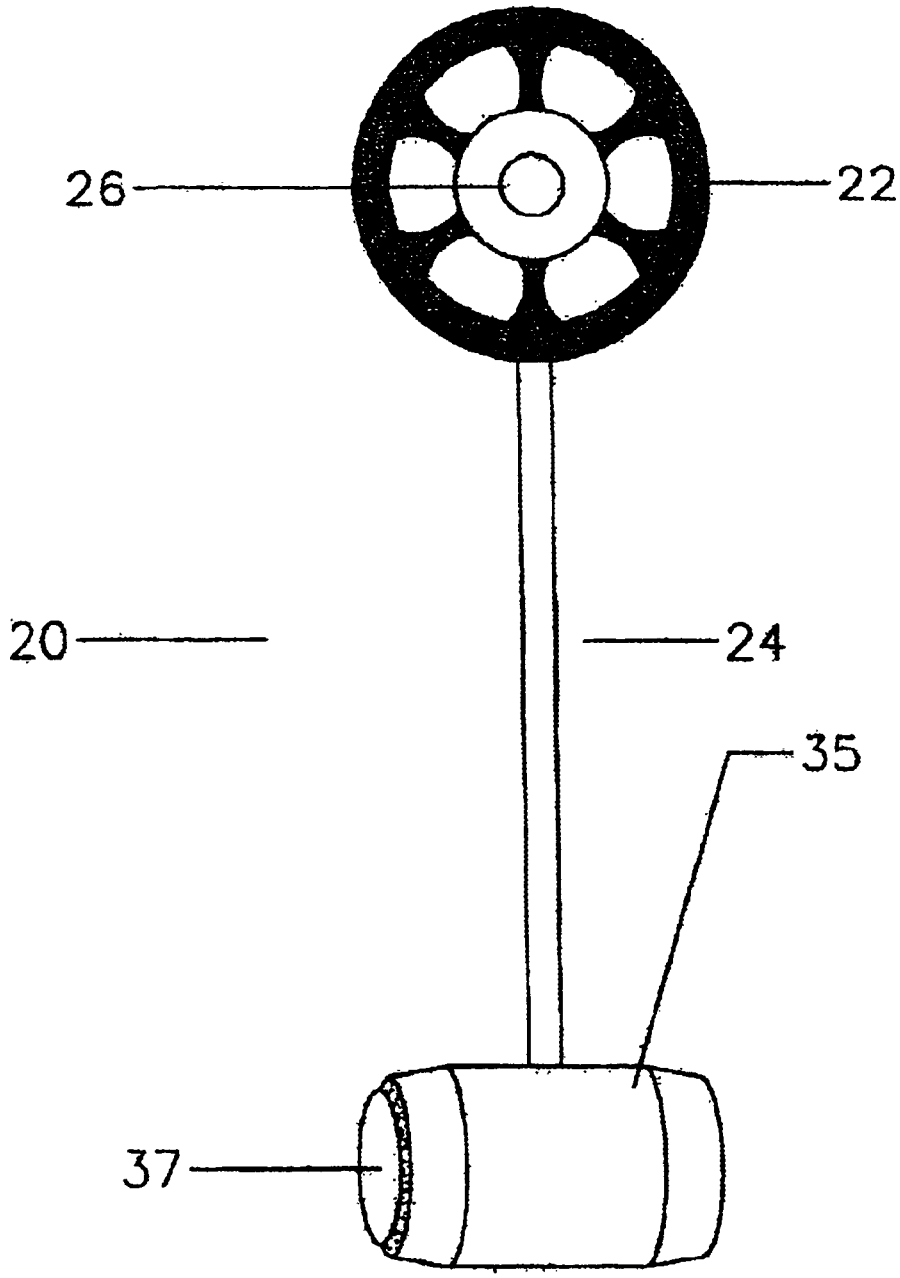
FIG. 4 displays the club.
Figure 5:
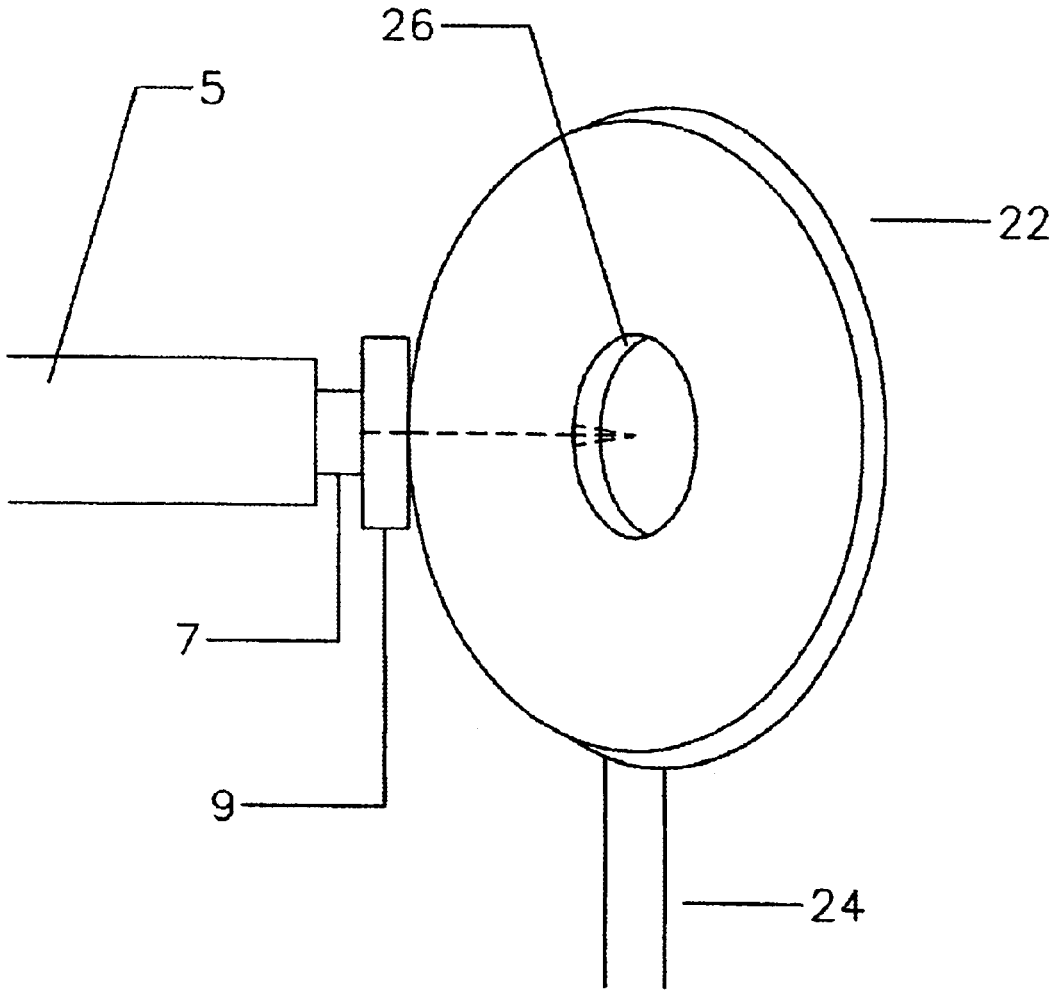
FIG. 5 shows the hub opening press fitting on the caster.

As shown in FIG. 4, the club 20 consists of a round wheel-like hub 22 with a shaft 24 that connects to the club head 35. The hub 22 of the club 20 has an opening 26 in the center. This opening 26 in the hub 22 is of a size that pressure fits onto the caster 9 of the pivoting means 25 as shown in FIG. 5. This pressure fit holds the club 20 onto the pivoting means 25 of the rod 5 while allowing for quick and easy assembling and disassembling. The hub opening 26 is located in the center of rotation and allows the club's head 35 to spin in an orbit around the pivot axis.

The shaft 24 can be of different lengths. The different lengths change the speed and force of the rotation. The plane of rotation is perpendicular to the rod 5 of the device 1.

The head 35 of the club 20 is fitted with a flat area 37 that faced in the direction of motion and is used to strike the projectile 120 forward when the device 1 is in use. The club heads 35 can be of different weights and sizes, which can change the force that is needed to rotate the club 20 and change the force with which the club 20 hits the projectile 120.

Clubs 20 can to be replaced from the pivoting means 25 with ease. This allows for quick replacement for clubs 20 with different lengths and shapes used to shoot accurately as target locations and degrees of difficulty change. It also allows the disassembly of the device 1 for easy storage and handling when not in use.

This device 1 can be fastened and used in different places on the user's body 40. The objective and method of operation remains the same. The idea is to add variety to the game and keep it interesting.

Figure 6:
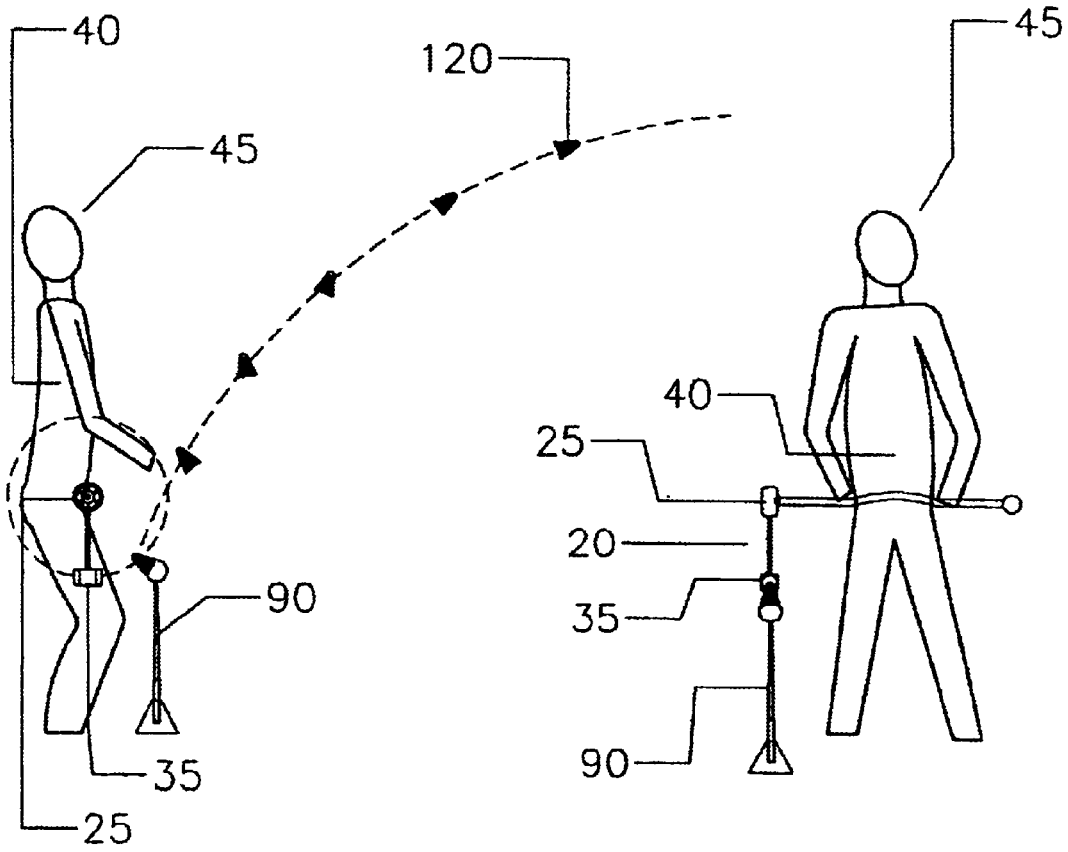
FIG. 6 shows a player using the device on their hips.

In the preferred embodiment, there are two main methods of using the device 1. In the first as shown in FIG. 6, the player 45 places the rod 5 horizontally across the abdomen with its two ends extending to the sides of the player's 45 body 40. The device 1 is secured with a strap 15 that straps around the user's back and holds the rod 5 from its two sides. The club 20 is located at one side of the operator's body 40. The player 40 moves his hips in an up and down, back and forth method to transfer force to the club 20 to get the club 20 to rotate. The player 45 also use their knees to aid in generating the force to get the club 20 to rotate around the pivoting means 25.

Figure 7:
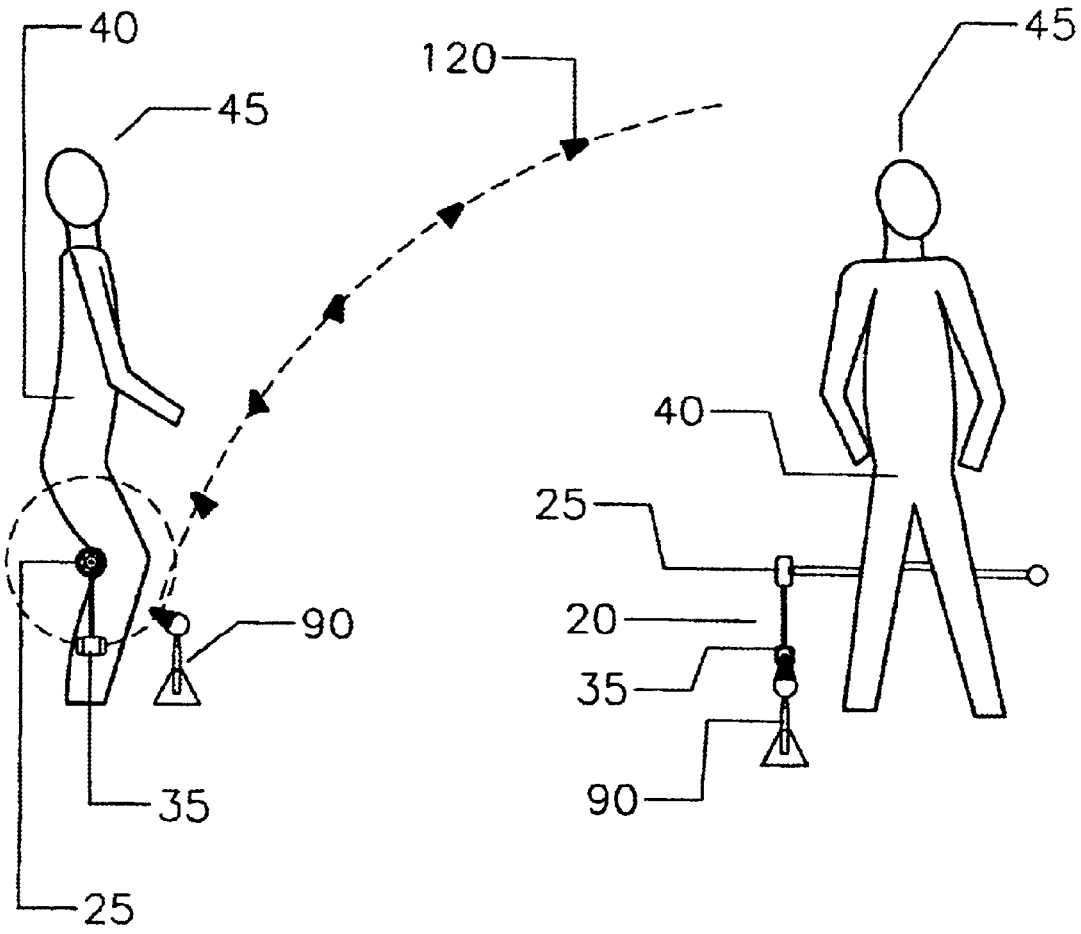
FIG. 7 shows a player using the device on their knees.

In the second method, as shown in FIG. 7, the player 45, with his knees bent at an angle, has the rod 5 placed at the back of the legs at the vertex behind the knees. The player 45 can use one or two hands to keep the device 1 secure in place as the rod 5 is pulled forward against the legs using either the strap 15 that protrudes between the knees as a handle or by holding the contour part of the rod 5. The pivoting club 20 is located at one side of the player's 45 body 40.

Figure 8:
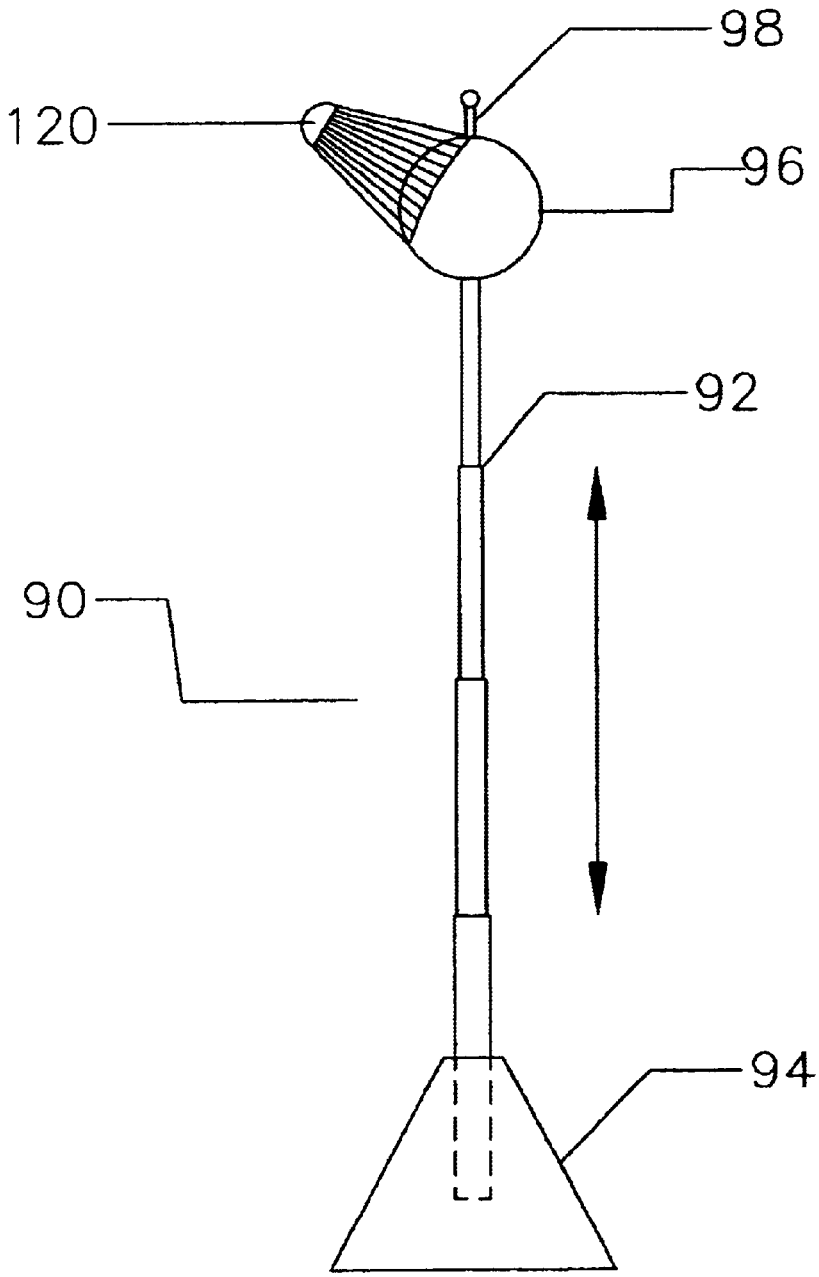
FIG. 8 shows the projectile holder.

As shown in FIG. 8, the projectile tee or holder 90 consists of an assembly of collapsible tubes 92 that are attached to a base 94 in one end and a support 96 for the projectile 120, which in the preferred embodiment is in the shape of a ball at the other end. The support 96 can be set at different heights by compressing or stretching on the tube 92 assembly while standing upright at the base 94. On top of the support there is a target holding means 98 such as a tab or screw that hooks and can set the projectile 120 at different angles by changing where the target holding means 98 is positioned at.

These two types of adjustments, namely height and angle of the projectile 120, are very important settings for accurate shooting because they determine the position at which the projectile 120 is presented to the club's head 35.

The projectile 120 can be of different shapes, but in the preferred embodiment it is a modified badminton shuttlecock. The projectile 120 can have Velcro on its tip to attach to a target 100. The projectile 120 can be designed for indoor or outdoor play and can be different shapes and sizes.

Figure 2:
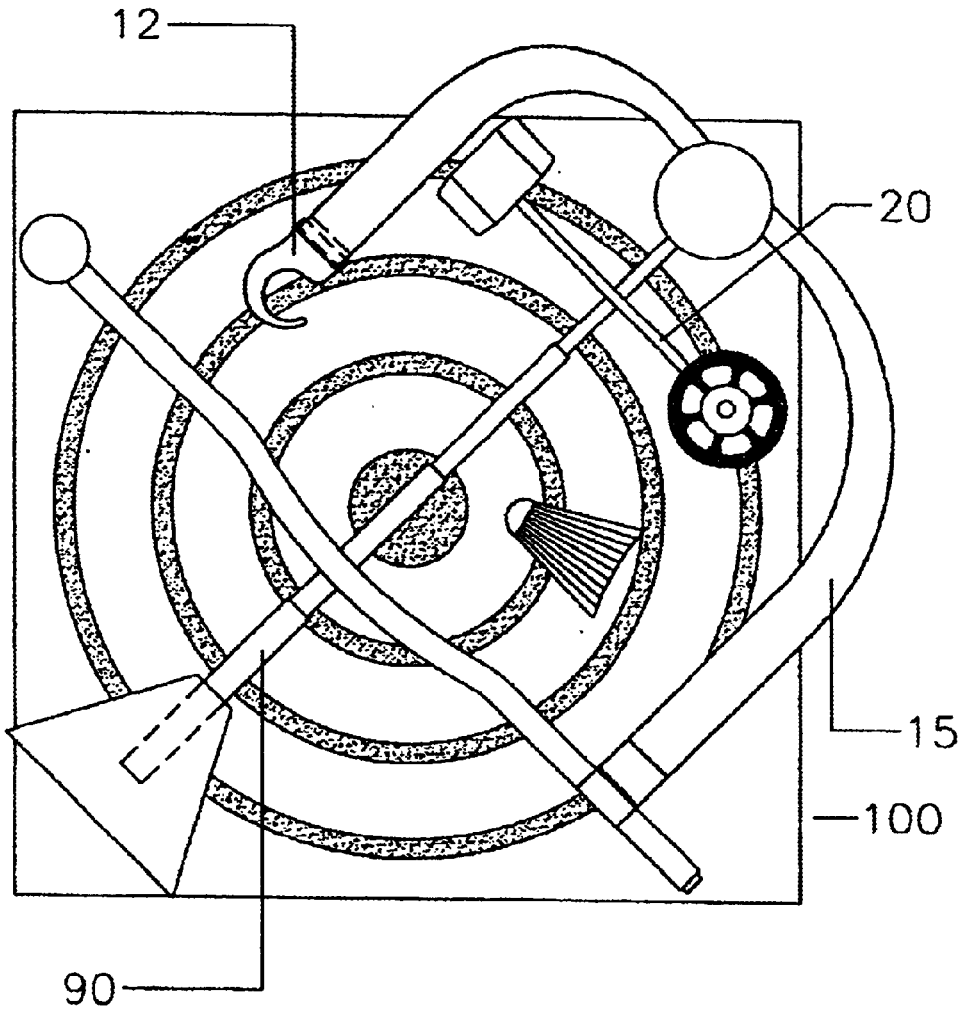
FIG. 2 shows the individual components of the device broken down.

The targets 100 can be of different types. The device 1 can also be used for long distance and altitude shooting competitions. FIG. 2 displays a flat square target 100 with a printed image to add scoring to the game.

Figure 9:
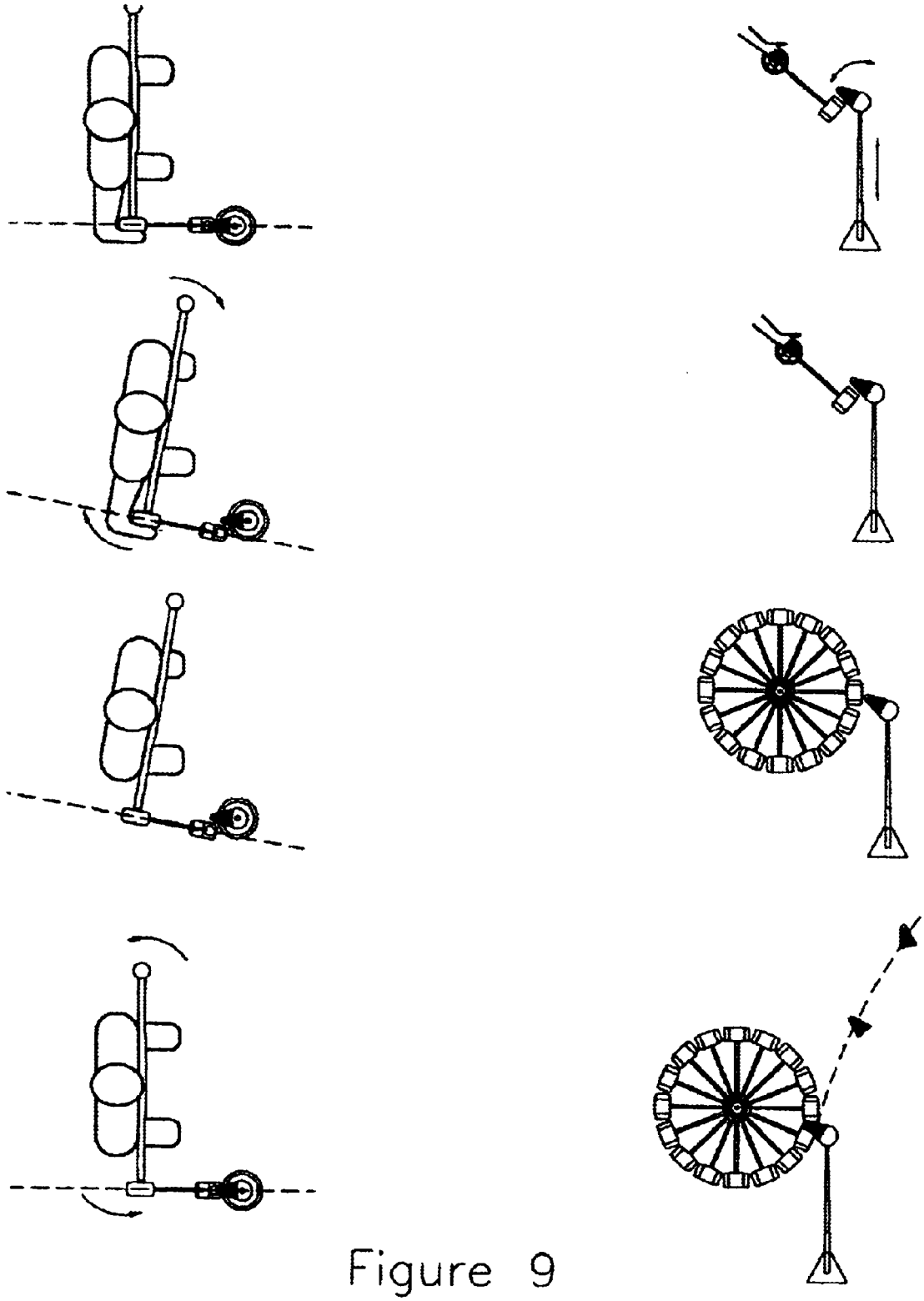
FIG. 9 shows the method of use.

The method of use is shown in FIG. 9. The player 45 wearing the device 1 as shown in FIGS. 6 and 7 would approach the holder 90 and adjust the height and angle at which the projectile 120 would sit on the holder 90.

The holder 90 can be readjusted for an ideal position to be attained. With the club head 35 still held close to the projectile 120, the player 45 makes a small twist of the waist that shifts the club's 20 plane of rotation slightly to the outside.

The player 45 can now start the rotation of the club 20 with the aid of their hand by twisting at the hub 22. After this initial push, the club 20 rotation is kept going by repeated thrusting movements of waist and/or knees. The player 40 controls the speed at which the club 20 rotates with the intensity and frequency of their movements, therefore controlling the energy required to strike projectiles 120 towards the desired target 100.

The player 45 rotates the club 20 in a perpendicular plane very close to the projectile 120 and builds to the speed necessary to make an accurate shot. When the time is right, the player 45 would twist the waist back to the original position in a quick, thrusting motion. If the elements of timing and motion are good, the club's head 35 would hit the projectile 120, propelling it forward towards the target 100. The quality of these two elements would be reflected in the accuracy of the shots; competition can easily be developed between players 45.

Figure 10:
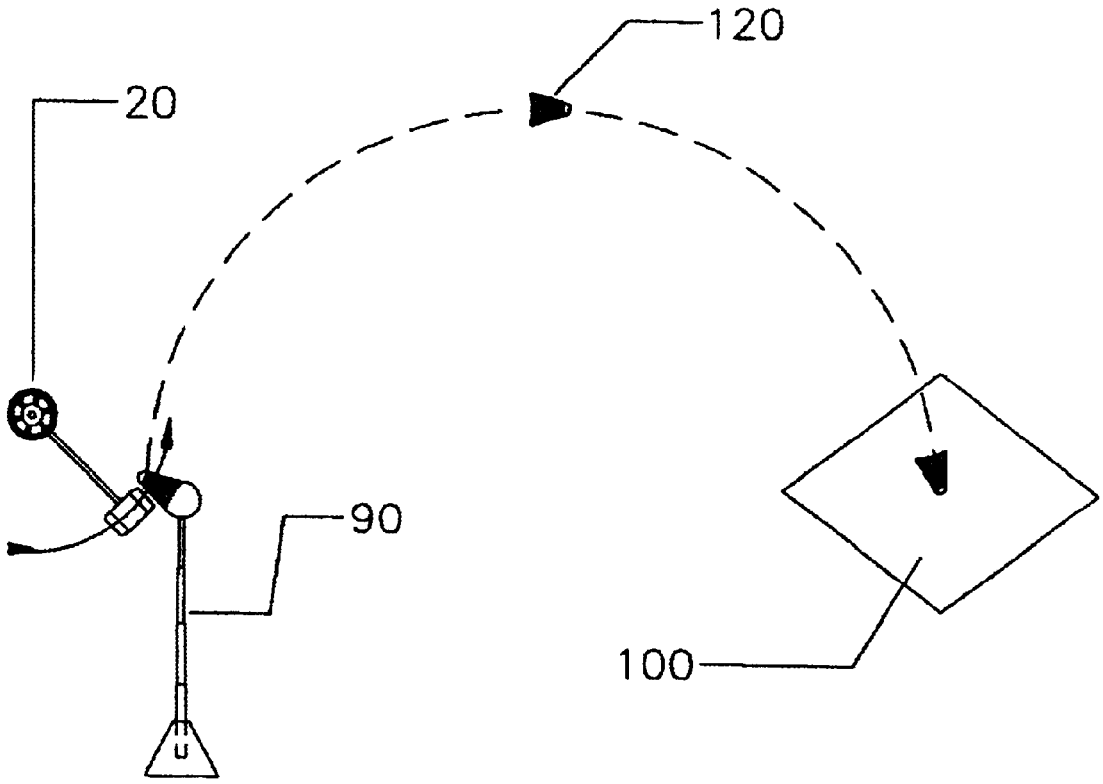
FIG. 10 shows the path of the projectile.

FIG. 10 shows the flight of the projectile 120. The club head 35 swings and hits the projectile 120. The projectile 120 has to be hit in the head for a smooth travel in the air as it sits on the target holding means 98 of the holder 90. This transfers force from the club head 35 to the projectile 120 causing the projectile 120 to leave the target holding means 98 and enter into the air. The projectile 120 arcs as its forward and upward momentum are stopped by air resistance and gravitational pull. This causes the projectile 120 to arc hopefully hitting the target 100.

The target 100 can have different areas which are worth different points, much like a dart board or shuffleboard. The target 100 can be made of a material that will attach to the Velcro that is on the projectile 120. The device 1 can also be used in a game that is similar to Frisbee golf.

ALTERNATIVE EMBODIMENT

In an alternative embodiment, the pivoting means can be a washer and bolt combination with the bolt being bolted to the end of the rod 5 to hold the club 20 on to the rod 5.

In another embodiment, the device 1 is fastened by having the strap 15 loop around the player's 45 body 40 and connecting to the tightening means 65 such as some type of buckling mechanism.

CONCLUSION

The device is a great and challenging game that is easy to play but takes skill. It helps build coordination and skill.

Although the present invention has been described in considerable detail with reference to certain preferred versions thereof, other versions are possible. Therefore, the point and scope of the appended claims should not be limited to the description of the preferred versions contained herein.

As to a further discussion of the manner of usage and operation of the present invention, the same should be apparent from the above description. Accordingly, no further discussion relating to the manner of usage and operation will be provided.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A device comprising:

a rod with a pivoting means on one end with a club attached to said pivoting means with said club pivoting around said rod on said pivoting means with said club having a club head and said club head having the ability to strike and propel projectiles with a strap connected to said rod to attach said rod to a person's body.

2. A device according to claim 1 in which said club is comprised of a hub which is attached to said pivoting means, and a shaft that connects the hub to said club head.

3. A device according to claim 2 in which said hub is attached to said pivoting means through the use of a press fit.

4. A device according to claim 1 where a plurality of clubs are used having different lengths and said club heads have different sizes and weights.

5. A holder for use with the device claim 1 to hold said projectile where said holder has a base a tube, a projectile support, a projectile support and an attachment means which holds a projectile in place.

6. A device according to claim 5 where said tube is a telescope tube.

7. A game which is played using the device of claim 1.

8. A game according to claim 7 where a plurality of clubs are used having different lengths and said club heads have different sizes and weights.

9. A game according claim 7 including a holder where said holder has a base, a telescope tube, a projectile support, a projectile support and an attachment means to hold said projectile in place.

10. A device comprising:

a rod with club attached to one end of said rod through an attachment means with said club pivoting around said rod with said club having a club head opposite said pivoting means and said club head having the ability to strike and propel projectiles, a strap connected to said rod to attach said rod to a person's body, said club is comprised of a hub which is attached to said pivoting means, a shaft that connects the hub to said club head, where said projectile is held by said attachment means and where projectile is hit by said club head.

11. A holder for use with the device of claim 10 to hold said projectile where said holder has a base, a tube, a projectile support, a projectile support and en attachment means which holds a projectile in place.

* * * * *